US012066225B2

(12) United States Patent
Su et al.

(10) Patent No.: US 12,066,225 B2
(45) Date of Patent: Aug. 20, 2024

(54) METHOD AND DEVICE FOR CONTROLLING PRESSURE OF UNITS WITH HEIGHT DROP, AND AIR CONDITIONER DEVICE

(71) Applicant: Gree Electric Appliances, Inc. of Zhuhai, Guangdong (CN)

(72) Inventors: Yuhai Su, Guangdong (CN); Jianguo Xiong, Guangdong (CN); Shiqiang Zhang, Guangdong (CN); Huachao Jiao, Guangdong (CN); Lianfa Wu, Guangdong (CN); Han Gao, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 382 days.

(21) Appl. No.: 17/066,784

(22) Filed: Oct. 9, 2020

(65) Prior Publication Data

US 2021/0025628 A1 Jan. 28, 2021

Related U.S. Application Data

(63) Continuation of application No. PCT/CN2018/121225, filed on Dec. 14, 2018.

(30) Foreign Application Priority Data

Apr. 9, 2018 (CN) ..... 201810311790.3

(51) Int. Cl.
*F25B 41/31* (2021.01)
*F25B 49/02* (2006.01)
(Continued)

(52) U.S. Cl.
CPC ..... *F25B 41/31* (2021.01); *F25B 49/02* (2013.01); *F24F 11/30* (2018.01); *F24F 2110/10* (2018.01); *F25B 2600/2513* (2013.01)

(58) Field of Classification Search
CPC .. F25B 41/31; F25B 49/02; F25B 2600/2513; F24F 2110/10; F24F 11/30
See application file for complete search history.

(56) References Cited

U.S. PATENT DOCUMENTS 4,987,747 A * 1/1991 Nakamura ..... F24F 3/065 62/278
5,277,034 A * 1/1994 Hojo ..... F25B 13/00 62/223
(Continued)

FOREIGN PATENT DOCUMENTS

CN 101451781 A 6/2009
CN 103712309 A 4/2014
(Continued)

OTHER PUBLICATIONS

Nabeshima et al., Air Conditioning System and Method for Removing Standing Gas, Oct. 20, 2000, JP2000292025A, Whole Document (Year: 2000).*
(Continued)

*Primary Examiner* — Larry L Furdge
(74) *Attorney, Agent, or Firm* — The Webb Law Firm

(57) ABSTRACT

Disclosed are a method and device for controlling pressure of units with height drop, and an air conditioner device. The method includes: monitoring an operating mode of the unit; obtaining an operating parameter corresponding to the operating mode according to the operating mode; and adjusting an opening degree of an electronic expansion valve according to the operating parameter.

20 Claims, 3 Drawing Sheets

(51) Int. Cl.
*F24F 11/30* (2018.01)
*F24F 110/10* (2018.01)

(56) References Cited

U.S. PATENT DOCUMENTS

| | | | | |
|---|---|---|---|---|
| 2009/0013700 | A1* | 1/2009 | Unezaki | F25B 13/00 62/77 |
| 2010/0024454 | A1* | 2/2010 | Kawano | F25B 13/00 62/238.6 |
| 2010/0037641 | A1* | 2/2010 | Kasahara | F25B 9/008 62/208 |
| 2011/0011125 | A1* | 1/2011 | Kasahara | F25B 49/02 62/513 |
| 2011/0232311 | A1* | 9/2011 | Korenaga | F24F 11/83 62/222 |
| 2019/0376727 | A1* | 12/2019 | Tamura | F24F 11/49 |

FOREIGN PATENT DOCUMENTS

| | | | | |
|---|---|---|---|---|
| CN | 104748293 | A | | 7/2015 |
| CN | 105928059 | A | | 9/2016 |
| CN | 106196495 | F | | 12/2016 |
| EP | 2144018 | A1 | | 1/2010 |
| EP | 3190357 | A1 | | 7/2017 |
| JP | H04289700 | A | | 10/1992 |
| JP | H06257865 | A | * | 9/1994 |
| JP | 2000292025 | A | * | 10/2000 |
| JP | 2015117854 | 16 | | 6/2015 |

OTHER PUBLICATIONS

Yamazaki et al., Air Conditioner, Sep. 16, 1994, JPH06257865A, Whole Document (Year: 1994).*

* cited by examiner

METHOD AND DEVICE FOR CONTROLLING PRESSURE OF UNITS WITH HEIGHT DROP, AND AIR CONDITIONER DEVICE

CROSS-REFERENCE TO RELATED APPLICATIONS

This application is a continuation of International Application No. PCT/CN2018/121225 filed Dec. 14, 2018, and claims priority to Chinese Patent Application No. 201810311790.3 filed Apr. 9, 2018, the disclosures of which are hereby incorporated by reference in their entirety.

BACKGROUND

Field

The present disclosure relates to a method and device for controlling pressure of units with height drop, and an air conditioner device.

Description of Related Art

In engineering installation, multi-connected air conditioner units are often confronted with such a circumstance that indoor and outdoor units are installed on different floors.

SUMMARY

According to various embodiments of the present disclosure, provided is a method for controlling pressure of units with height drop, comprising: monitoring an operating mode of the units; obtaining an operating parameter corresponding to the operating mode according to the operating mode; and adjusting an opening degree of an electronic expansion valve according to the operating parameter.

According to various embodiments of the present disclosure, provided is a device for controlling pressure of units with height drop, comprising: a memory; and a processor coupled to the memory, and configured to, based on instructions stored in the memory, carry out a method for controlling pressure of units with height drop, the method comprising: monitoring an operating mode of the units, obtaining an operating parameter corresponding to the operating mode according to the operating mode, and adjusting an opening degree of an electronic expansion valve according to the operating parameter.

According to various embodiments of the present disclosure, provided is a nonvolatile computer-readable storage medium on which computer program instructions are stored, the instructions, when executed by a processor, implement a method for controlling pressure of units with height drop, the method comprising: monitoring an operating mode of the units, obtaining an operating parameter corresponding to the operating mode according to the operating mode, and adjusting an opening degree of an electronic expansion valve according to the operating parameter.

The present disclosure also provides an air conditioner device, comprising the device for controlling pressure of units with height drop according to any one of the above embodiments.

DESCRIPTION

The present disclosure will be further described in detail below in conjunction with the accompanying drawings and specific embodiments. It should be understood that, the specific embodiments described here are only intended to explain rather than limit the present disclosure.

In the following description, the use of suffixes such as "module", "member" or "unit" for indicating an element which is only intended to facilitate the description of the present disclosure, has no specific meaning in itself. Therefore, "module" "member" or "unit" can be used in a mixed manner.

The inventors have noticed that height drop between an outdoor unit and an indoor unit of result in that a refrigerant circulation is affected by gravity and accumulated in a low position of the multi-connected air conditioner units system, thereby affecting the performance of the system.

Figure 1:
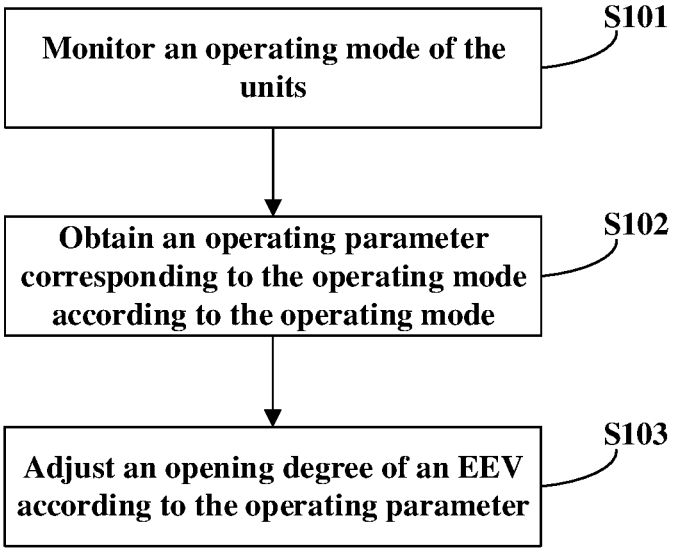
FIG. 1 is a flowchart showing a method for controlling pressure of height drop of units according to one or more embodiments of the present disclosure.

FIG. 1 is a flowchart showing a method for controlling pressure of height drop of units according to embodiments of the present disclosure. As shown in FIG. 1, the method comprises the following steps.

At step S101, an operating mode of the units is monitored.

At step S102, an operating parameter corresponding to the operating mode is obtained according to the operating mode.

At step S103, an opening degree of an electronic expansion valve (EEV) is adjusted according to the operating parameter.

In some embodiments, corresponding parameters are obtained in different operating modes of the units, so that the opening degrees of the EEVs of the indoor units and the EEVs of the outdoor units are adjusted according to the parameters, thereby changing an intermediate pressure of the refrigerant circulation, and ensuring that the system has sufficient power to promote the refrigerant circulation. With a reduced adverse effect of height drop between the indoor and outdoor units on the refrigerant circulation, the performance of the units is improved, and the flexible degree during engineering installation is improved.

The operating mode of units involved in some embodiments comprises at least one of the following: a cooling mode or a heating mode. If the operating mode is the cooling mode, an evaporation temperature of refrigerant of an indoor unit of the units, an opening degree of the EEV of the indoor unit, a suction pressure of an outdoor unit of the units, and a temperature of exhaust gas which are in the cooling mode are obtained. If the operating mode is the heating mode, the condensation temperature of refrigerant of the indoor unit, the suction pressure of the outdoor unit, and the temperature of the exhaust gas which are in the heating mode are obtained. Since the common modes of air conditioner device basically consist in the cooling mode and the heating mode, the present disclosure will mainly introduce the adjustment of the opening degree of the EEV in these two operating modes. Of course, for other operating modes of the air conditioner device, the opening degrees of the EEVs of the indoor unit and the outdoor unit are also adjusted according to the corresponding parameters. On such basis, corresponding parameters are obtained for different operating modes, so that the current operating conditions of the units and the pressure of the system can be accurately evaluated, thereby providing a basis for subsequent accurate adjustment of the opening degree of the EEV.

In the technical solutions of some embodiments, the opening degrees of the EEVs of the indoor and outdoor units are adjusted to control an intermediate pressure of the system. In different operating modes, different control methods are used due to the different refrigerant circulation directions of the system.

Next, how to adjust the opening degree of the EEV mainly in a cooling mode and a heating mode will be introduced in detail.

I. When the system is in the cooling operation, the intermediate pressure section of the system is located from a posterior of the EEV of the outdoor unit to an anterior of the EEV of the indoor unit. The main operating parameters obtained comprise parameters such as the evaporation temperature of refrigerant of the indoor unit, the opening degree of the EEV of the indoor unit, a pressure of an exhaust gas and a suction pressure of an outdoor unit, and the temperature of the exhaust gas.

If the above operating parameter satisfies the following conditions at the same time: the opening degree of the EEV of the indoor unit is smaller than a preset value or a superheat degree of the indoor unit (for example, the superheat degree of the indoor unit is determined according to the evaporation temperature of refrigerant of the indoor unit) is smaller than a preset value, the suction pressure of the outdoor unit is smaller than a preset value, and a superheat degree of the exhaust gas (for example, the superheat degree of the exhaust gas is determined according to the temperature of the exhaust gas) is greater than a preset value, it is determined that the intermediate pressure of the system is too low and the circulating power is inadequate to urge the refrigerant of the indoor unit to flow to the outdoor unit. At this time, the opening degree of the EEV of the outdoor unit is adjusted to increase, according to a difference between the suction pressure of the outdoor unit and the corresponding preset value and a difference between the superheat degree of the exhaust gas and the corresponding preset value. The adjustment amplitude of the opening degree of the EEV of the outdoor unit is related with the values of these two differences. The larger the differences are, the greater the adjustment amplitude will be. The ultimate object is to reduce the difference between the suction pressure of the outdoor unit and the corresponding preset value and the difference between the superheat degree of the exhaust gas and the corresponding preset value, raise the intermediate pressure of the system, and promote the refrigerant circulation at the indoor unit.

If the above operating parameter satisfies the following conditions at the same time: the opening degree of the EEV of the indoor unit is greater than a preset value or the superheat degree of the indoor unit is greater than a preset value, the suction pressure of the outdoor unit is greater than a preset value, and the superheat degree of the exhaust gas is smaller than a preset value, it is determined that the intermediate pressure of the system is too high, and the circulating power makes an excessive amount of the refrigerant of the outdoor unit. At this time, the opening degree of the EEV of the outdoor unit is adjusted to decrease, according to the difference between the suction pressure of the outdoor unit and the corresponding preset value and the difference between the superheat degree of the exhaust gas and the corresponding preset value. The adjustment amplitude of the opening degree of the EEV of the outdoor unit is related with the values of these two differences. The larger the differences are, the greater the adjustment amplitude will be. The ultimate object is to reduce the difference between the suction pressure of the outdoor unit and the corresponding preset value and the difference between the superheat degree of the exhaust gas and the corresponding preset value, reduce the intermediate pressure of the system, and control the refrigerant circulation amount to be within a reasonable range.

Based on the above analysis, some implementations are provided. That is, in the cooling mode, if the operating parameter satisfies a first preset condition, the opening degree of the EEV of the outdoor unit is adjusted to increase; and if the operating parameter satisfies a second preset condition, the opening degree of the EEV of the outdoor unit is adjusted to decrease. The first preset condition is that: the opening degree of the EEV of the indoor unit is smaller than a preset opening degree value, the superheat degree of the indoor unit determined according to the evaporation temperature of refrigerant of the indoor unit is smaller than a preset superheat value, the suction pressure of the outdoor unit is smaller than a preset pressure value, and the superheat degree of the exhaust gas determined according to the temperature of the exhaust gas is greater than a preset exhaust gas value. The second preset condition is that: the opening degree of the EEV of the indoor unit is greater than the preset opening value, the superheat degree of the indoor unit determined according to the evaporation temperature of refrigerant of the indoor unit is greater than the preset superheat value, the suction pressure of the outdoor unit is greater than the pressure preset value, and the superheat degree of the exhaust gas determined according to the temperature of the exhaust gas is smaller than the exhaust gas preset value. On such basis, in the cooling mode, the intermediate pressure of the system is acknowledged in real time according to the operating parameter and controlled, so that the refrigerant circulation amount is within a reasonable range to ensure that the system has sufficient power to promote the refrigerant circulation. The adverse effect of the height drop between the indoor and outdoor units on the refrigerant circulation is reduced and the performance of the units is improved.

II. When the system is in a heating operation, the intermediate pressure section is located from a posterior of the EEV of the indoor unit to an anterior of the EEV of the outdoor unit. The main operating parameters obtained comprise parameters such as the condensation temperature of refrigerant of the indoor unit, the opening degree of the EEV of the outdoor unit, the pressure of the exhaust gas and the suction pressure of the outdoor unit, and the temperature of the exhaust gas.

If the above operating parameter satisfies the following conditions at the same time: the subcooling degree of the indoor unit (the tube-out temperature of the indoor unit minus the tube-in temperature of the indoor unit) is smaller than a preset value, the suction pressure of the outdoor unit is smaller than a preset value, the superheat degree of the exhaust gas is greater than a preset value, it is determined that the intermediate pressure of the system is too high and the circulating power is inadequate to urge the refrigerant of the indoor unit to flow to the outdoor unit. At this time, the opening degree of the EEV of the indoor unit is adjusted to decrease, according to the difference between the suction pressure of the outdoor unit and the corresponding preset value and the difference between the superheat degree of the exhaust gas and the corresponding preset value. The adjustment amplitude of the opening degree of the EEV of the indoor unit is related with the values of these two differences. The larger the differences are, the greater the adjustment amplitude will be. The ultimate object is to reduce the difference between the suction pressure of the outdoor unit and the corresponding preset value and the difference between the superheat degree of the exhaust gas and the corresponding preset value, reduce the intermediate pressure of the system, and promote the refrigeration circulation at the indoor unit.

If the above operating parameter satisfies the following conditions at the same time: the subcooling degree of the indoor unit is greater than a preset value, the suction pressure of the outdoor unit is greater than a preset value, and the superheat degree of the exhaust gas is smaller than a preset value, it is determined that the system intermediate pressure is too low, and the refrigerant of the indoor unit flows back fast. At this time, the opening degree of the EEV of the indoor unit is adjusted to increase, according to the difference between the suction pressure of the outdoor unit and the corresponding preset value and the difference between the superheat degree of the exhaust gas and the corresponding preset value. The adjustment amplitude of the opening degree of the EEV of the indoor unit is related with the values of these two differences. The larger the differences are, the greater the adjustment amplitude will be. The ultimate object is to reduce the difference between the suction pressure of the outdoor unit and the corresponding preset value and the difference between the superheat degree of the exhaust gas and the corresponding preset value, raise the intermediate pressure of the system, and control the refrigerant circulation amount to be within a reasonable range.

Based on the above analysis, some implementations are provided. That is, in the heating mode, if the operating parameter satisfies a third preset condition, the opening degree of the EEV of the indoor unit is adjusted to decrease; if the operating parameter satisfies a fourth preset condition, the opening degree of the EEV of the indoor unit is adjusted to increase. The third preset condition is that: the subcooling degree of the indoor unit determined according to the condensation temperature of refrigerant of the indoor unit is smaller than a preset subcooling value, the suction pressure of the outdoor unit is smaller than a preset pressure value, and the superheat degree of the exhaust gas determined according to the temperature of the exhaust gas is greater than a preset exhaust gas value. The fourth preset condition is that: the subcooling degree of the indoor unit determined according to the condensation temperature of refrigerant of the indoor unit is greater than the preset supercooling value, the suction pressure of the outdoor unit is greater than the preset pressure value, and the superheat degree of the exhaust gas determined according to the temperature of the exhaust gas is smaller than the preset exhaust gas value. On such basis, in the heating mode, the intermediate pressure of the system is acknowledged in real time according to the operating parameter and controlled, so that the refrigerant circulation amount is within a reasonable range to ensure that the system has sufficient power to promote the refrigerant circulation. The adverse effect of the height drop between the indoor and outdoor units on the refrigerant circulation is reduced and the performance of the units is improved.

It should be noted that, in some embodiments, the specific values of the above plurality of preset values are set and adjusted according to actual conditions and actual needs.

In some embodiments, when the opening degree of the EEV is adjusted, the opening degree of the EEV is adjusted according to the difference between the suction pressure of the outdoor unit and the preset pressure value, and the difference between the superheat degree of the exhaust gas and the preset exhaust gas value. On such basis, in some embodiments, the adjustment standard of the opening degree of the EEV refers to the values of the above two differences, thereby implementing accurate adjustment to the opening degree of the EEV, so that the refrigerant circulation mount is within a reasonable range to ensure that the system has sufficient power to enhance the refrigerant circulation. The adverse effect of the height drop between the indoor and outdoor units on the refrigerant circulation is reduced and the performance of the units is improved.

Figure 2:
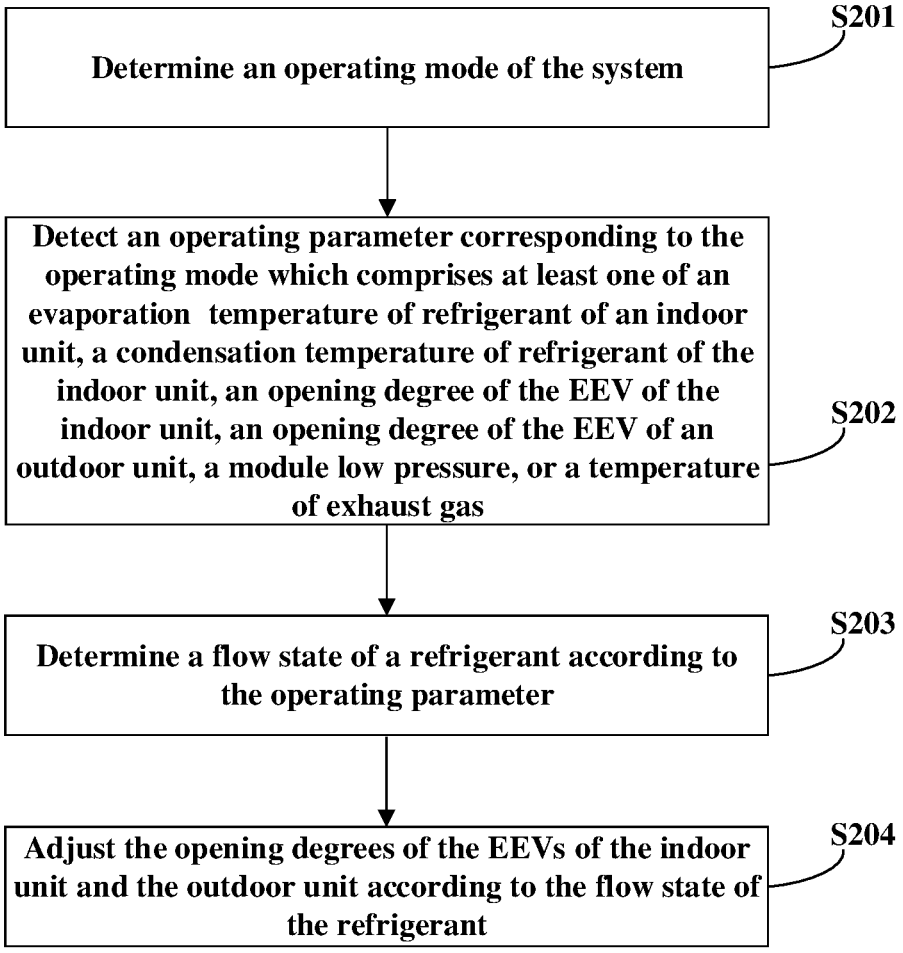
FIG. 2 is a flowchart showing a method for controlling refrigerant of the system according to one or more embodiments of the present disclosure.

FIG. 2 is a flowchart showing a method for controlling refrigerant of the system according to embodiments of the present disclosure. As shown in FIG. 2, the flow comprises the following steps (step S201-step S204).

At step S201, an operating mode of the system is determined.

At step S202, an operating parameter corresponding to the operating mode is detected. The operating parameter comprise at least one of the following: an evaporation temperature of refrigerant of an indoor unit, a condensation temperature of refrigerant temperature of the indoor unit, an opening degree of the EEV of the indoor unit, an opening degree of the EEV of an outdoor unit, a suction pressure of an outdoor unit, or a temperature of exhaust gas.

Specifically, in a cooling mode, the operating parameter comprises at least one of the following: the evaporation temperature of refrigerant of the indoor unit, the opening degree of the EEV of the indoor unit, the suction pressure of the outdoor unit, or the temperature of the exhaust gas; in a heating mode, the operating parameter comprises at least one of the following: the condensation temperature of refrigerant of the indoor unit, the suction pressure of the outdoor unit, or the temperature of the exhaust gas.

At step S203, a flow state of a refrigerant is determined according to the operating parameter.

Specifically, in the cooling mode, if the operating parameter satisfies the following conditions at the same time: the opening degree of the EEV of the indoor unit is smaller than a preset value or the superheat degree of the indoor unit is smaller than a preset value, the suction pressure of the outdoor unit is smaller than a preset value, and the superheat degree of the exhaust gas is greater than a preset value, it is determined that the intermediate pressure of the system is too low and the circulating power is inadequate to urge the refrigerant of the indoor unit to flow to the outdoor unit; if the operating parameter satisfies the following conditions at the same time: the opening degree of the EEV of the indoor unit is greater than a preset value or the superheat degree of the indoor unit is greater than a preset value, the suction pressure of the outdoor unit is greater than a preset value, and the superheat degree of the exhaust gas is smaller than a preset value, it is determined that the system intermediate pressure is too high and the circulating power makes an excessive amount of the refrigerant of the outdoor unit.

In the heating mode, if the operating parameter satisfies the following conditions at the same time: the subcooling degree of the indoor unit is smaller than a preset value, the suction pressure of the outdoor unit is smaller than a preset value, and the superheat degree of the exhaust gas is greater than a preset value, it is determined that the intermediate pressure of the system is too high and the circulating power is inadequate to urge the refrigerant of the indoor unit to flow to the outdoor unit. If the operating parameter satisfies that the subcooling degree of the indoor unit is greater than a preset value, the suction pressure of the outdoor unit is greater than a preset value, and the superheat degree of the exhaust gas is smaller than a preset value at the same time, it is determined that the system intermediate pressure is too low and the refrigerant of the indoor unit flows back fast.

At step S204, the opening degrees of the EEVs of the indoor unit and the outdoor unit according to the flow state of the refrigerant adjusting. The specific adjustment solutions have been described in detail above and thus will not be described in detail here.

On such basis, the opening degree of the EEV is accurately adjusted, so that the refrigerant circulation mount is within a reasonable range, thereby reducing the adverse effect of the height drop between the indoor and outdoor units on the refrigerant circulation and improving the performance of the units.

Figure 3:
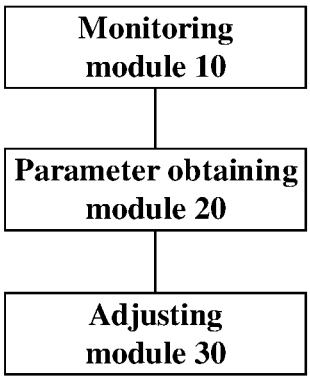
FIG. 3 is a structural block view showing a device for controlling pressure of height drop of units according to one or more embodiments of the present disclosure.
Figure 4:
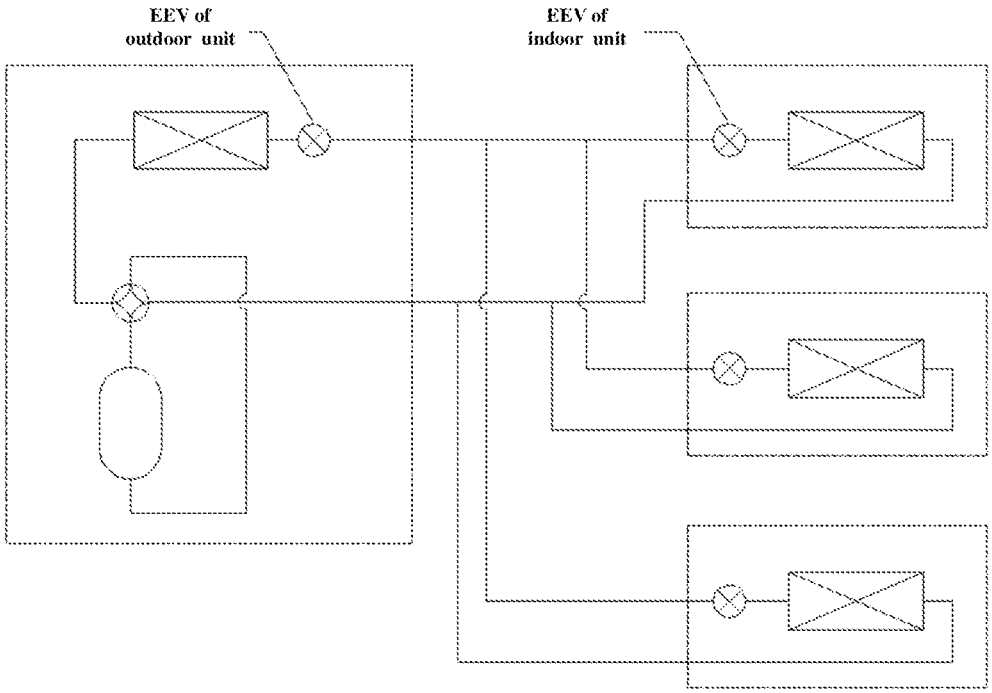
FIG. 4 is a block view showing the EEVs of indoor and outdoor units.

Corresponding to the method for controlling pressure of height drop of units introduced in FIG. 1, some embodiments provide a device for controlling pressure of height drop of units. In the structural block view of the device for controlling pressure of height drop of units as shown in FIG. 3, the device comprises: a monitoring module 10 configured to monitor an operating mode of the units; a parameter obtaining module 20 connected to the monitoring module 10 and configured to obtain an operating parameter corresponding to the operating mode according to the operating mode; and an adjusting module 30 connected to the parameter obtaining module 20 and configured to adjust an opening degree of an electronic expansion valve (EEV) according to the operating parameter.

In some embodiments, corresponding parameters are obtained in different operating modes of the units, so that the opening degrees of the EEVs of the indoor units and the EEVs of the outdoor units are adjusted according to the parameters, thereby changing an intermediate pressure of the refrigerant circulation, and ensuring that the system has sufficient power to promote the refrigerant circulation. With a reduced adverse effect of height drop between the indoor and outdoor units on the refrigerant circulation, the performance of the units is improved, and the flexible degree during engineering installation is improved.

The operating mode involved in some embodiments comprises at least one of the following: a cooling mode or a heating mode. If the operating mode is the cooling mode, the above parameter obtaining module 20 is configured to obtain an evaporation temperature of refrigerant of an indoor unit, an opening degree of the EEV of the indoor unit, a suction pressure of an outdoor unit, and a temperature of exhaust gas in the cooling mode. If the operating mode is the heating mode, the above parameter obtaining module 20 is configured to obtain a condensation temperature of refrigerant of the indoor unit, the suction pressure of the outdoor unit, and the temperature of the exhaust gas in the heating mode. Of course, for other operating modes of the air conditioner device, in some embodiments, the opening degrees of the EEVs of the indoor unit and the outdoor unit are also adjusted according to the corresponding parameters. On such basis, corresponding parameters are obtained for different operating modes, so that the current operating conditions of the units and the pressure of the system can be accurately evaluated, thereby providing a basis for subsequent accurate adjustment of the opening degree of the EEV.

In the technical solutions of some embodiments, the opening degrees of the EEVs of the indoor and outdoor units are adjusted to control an intermediate pressure of the system. In different operating modes, different control methods are used due to the different refrigerant circulation directions of the system.

On such basis, some implementations are provided. That is, if the operating mode is a cooling mode, the above adjusting module 30 comprises: a first adjusting unit configured to adjust the opening degree of the EEV of the outdoor unit to increase, in a case where the operating parameter satisfies a first preset condition, wherein the first preset condition is that: the opening degree of the EEV of the indoor unit is smaller than a preset opening degree value, the superheat degree of the indoor unit determined according to the evaporation temperature of refrigerant of the indoor unit is smaller than a preset superheat value, the suction pressure of the outdoor unit is smaller than a preset pressure value, and the superheat degree of the exhaust gas determined according to the temperature of the exhaust gas is greater than a preset exhaust gas value; and a second adjusting unit configured to adjust the opening degree of the EEV of the outdoor unit to decrease, in a case where the operating parameter satisfies a second preset condition, wherein the second preset condition is that: the opening degree of the EEV of the indoor unit is greater than the preset opening degree value, the superheat degree of the indoor unit determined according to the evaporation temperature of refrigerant of the indoor unit is greater than the preset superheat value, the suction pressure of the outdoor unit is greater than the preset pressure value, and the superheat degree of the exhaust gas determined according to the temperature of the exhaust gas is smaller than the preset exhaust gas value.

If the operating mode is the heating mode, the above adjusting module 30 comprises: a third adjusting unit configured to adjust the opening degree of the EEV of the indoor unit to decrease, in a case where the operating parameter satisfies a third preset condition, wherein the third preset condition is that: a subcooling degree of the indoor unit determined according to the condensation temperature of refrigerant of the indoor unit is smaller than a preset subcooling value, the suction pressure of the outdoor unit is smaller than the preset value of pressure, and the superheat degree of the exhaust gas determined according to the temperature of the exhaust gas is greater than the preset exhaust gas value; and a fourth adjusting unit configured to adjust the opening degree of the EEV of the indoor unit to increase, in a case where the operating parameter satisfies a fourth preset condition, wherein the fourth preset condition is that: the subcooling degree of the indoor unit determined according to the condensation temperature of refrigerant of the indoor unit is smaller than the preset supercooling value, the suction pressure of the outdoor unit is greater than the preset pressure value, and the superheat degree of the exhaust gas determined according to the temperature of the exhaust gas is smaller than the preset exhaust gas value.

On such basis, in the cooling mode or the heating mode, the intermediate pressure of the system is acknowledged in real time according to the operating parameter and controlled, so that the refrigerant circulation amount is within a reasonable range to ensure that the system has sufficient power to promote the refrigerant circulation. The adverse effect of the height drop between the indoor and outdoor units on the refrigerant circulation is reduced and the performance of the units is improved.

In some embodiments, the above adjusting module 30 is specifically configured to adjust the opening degree of the EEV according to a difference between the suction pressure of the outdoor unit and the preset pressure value, and a difference between the superheat degree of the exhaust gas and the preset exhaust gas value. On such basis, in some embodiments, the adjustment standard of the opening degree of the EEV refers to the values of the above two differences, thereby implementing accurate adjustment to the opening degree of the EEV, so that the refrigerant circulation mount is within a reasonable range to ensure that the system has sufficient power to promote the refrigerant circulation. The adverse effect of the height drop between the indoor and outdoor units on the refrigerant circulation is reduced and the performance of the units is improved.

The present disclosure also provides an air conditioner device comprising the device for controlling pressure of height drop of units introduced as above, thereby implementing controlling the refrigerant circulation of the multi-connected air conditioner device, and avoiding that the refrigerant circulation is affected by height drop between the indoor and outdoor units on.

It can be seen from the above description that in the present disclosure, corresponding parameters are obtained in different operating modes of the units, so that the opening degrees of the EEVs of the indoor units and the EEVs of the outdoor units are adjusted according to the parameters, thereby changing an intermediate pressure of the refrigerant circulation, and ensuring that the system has sufficient power to promote the refrigerant circulation. With a reduced adverse effect of height drop between the indoor and outdoor units on the refrigerant circulation, the performance of the units is improved, and the flexible degree during engineering installation is improved.

It should be noted that, in this text, the terms "comprise", "consist" or any other variants thereof are intended to encompass non-exclusive inclusion, so that a process, a method, an article or a device comprising a series of elements not only comprises those elements, but also comprises other elements not explicitly listed, or also comprise elements inherent to the process, the method, the article, or the device. In a case where there are no more restrictions, the element defined by the phase "comprising a/an . . . " does not exclude that other same element(s) is/are also present in the process, the method, the article or the device that comprises the element.

The serial numbers of the above embodiments of the present disclosure are only intended for description, and do not represent the advantages and disadvantages of the embodiments.

By way of the description of the above embodiments, those skilled in the art can clearly understand that, in some embodiments, the method of the above embodiments is implemented by means of software and a necessary general hardware platform. Of course, in some embodiments, it is also implemented by hardware. However, in many cases, the former is a better implementation. Based on such understanding, the technical solution of the present disclosure essentially or the part that contributes to the art known to the inventors is embodied in the form of a software product. The computer software product is stored in a storage medium (such as ROM/RAM, magnetic disk, or compact disk), comprising several instructions to make a mobile terminal (which is, for example, a mobile phone, a computer, a server, an air-conditioner, or a network device and the like) implement the method described in various embodiments of the present disclosure.

The embodiments of the present disclosure are described above in conjunction with the drawings, but the present disclosure is not limited to the above specific embodiments. The above specific embodiments are only illustrative but not restrictive. Under the suggestion of the present disclosure, those of ordinary skill in the art can also make many forms without departing from the purpose of the present disclosure and the protection scope of the claims, which are all within the protection of the present disclosure.

What is claimed is:

1. A method for controlling pressure of units with height drop, comprising:

monitoring an operating mode of the units;

obtaining an operating parameter corresponding to the operating mode according to the operating mode, comprising:

obtaining, by a device configured to monitor operating parameters while in a cooling mode, an evaporation temperature of refrigerant of an indoor unit of the units, an opening degree of an electronic expansion valve (EEV) of the indoor unit, a suction pressure of an outdoor unit of the units, and a temperature of exhaust gas, in a case where the operating mode is the cooling mode; and adjusting an opening degree of an EEV according to the operating parameter, comprising:

adjusting an opening degree of an EEV of the outdoor unit to increase, to raise an intermediate pressure located from a posterior of the EEV of the outdoor unit to an anterior of the EEV of the indoor unit, in a case where the operating parameter satisfies a first preset condition, wherein the first preset condition is:

the opening degree of the EEV of the indoor unit is smaller than a preset opening degree value, or a superheat degree of the indoor unit determined according to the evaporation temperature of refrigerant of the indoor unit is smaller than a preset superheat value, the suction pressure of the outdoor unit is smaller than a preset pressure value, and a superheat degree of the exhaust gas determined according to the temperature of the exhaust gas is greater than a preset exhaust gas value; and adjusting the opening degree of the EEV of the outdoor unit to decrease, to reduce the intermediate pressure, in a case where the operating parameter satisfies a second preset condition, wherein the second preset condition is:

the opening degree of the EEV of the indoor unit is greater than the preset opening degree value or the superheat degree of the indoor unit determined according to the evaporation temperature of refrigerant of the indoor unit is greater than the preset superheat value, the suction pressure of the outdoor unit is greater than the pressure preset value, and the superheat degree of the exhaust gas determined according to the temperature of the exhaust gas is smaller than the preset exhaust gas value;

wherein the outdoor unit and the indoor unit have the height drop therebetween, wherein, in the case where the operating parameter satisfies the first preset condition, it is determined that the intermediate pressure is too low, and wherein, in the case where the operating parameter satisfies the second preset condition, it is determined that the intermediate pressure is too high.

2. The method according to claim 1, wherein the operating mode comprises a heating mode.

3. The method according to claim 2, wherein in a case where the operating mode is the heating mode, the obtaining the operating parameter corresponding to the operating mode according to the operating mode comprises:

obtaining, in the heating mode, a condensation temperature of refrigerant of the indoor unit, the suction pressure of the outdoor unit, and the temperature of the exhaust gas.

4. The method according to claim 3, wherein in a case where the operating mode is the heating mode, the adjusting the opening degree of the electronic expansion valve according to the operating parameter comprises:

adjusting an opening degree of an electronic expansion valve of the indoor unit, in a case where the operating parameter satisfies a third preset condition, wherein the third preset condition is:

a subcooling degree of the indoor unit determined according to the condensation temperature of refrigerant of the indoor unit is smaller than a preset subcooling value, the suction pressure of the outdoor unit is smaller than a preset pressure value, and a superheat degree of the exhaust gas determined according to the temperature of the exhaust gas is greater than a preset exhaust gas value;

and adjusting the opening degree of the electronic expansion valve of the indoor unit to increase, in a case where the operating parameter satisfies a fourth preset condition, wherein the fourth preset condition is:

the subcooling degree of the indoor unit determined according to the condensation temperature of refrigerant of the indoor unit is greater than the preset subcooling value, the suction pressure of the outdoor unit is greater than the preset pressure value, and the superheat degree of the exhaust gas determined according to the temperature of the exhaust gas is smaller than the preset exhaust gas value.

5. The method according to claim 1, wherein the adjusting the opening degree of the electronic expansion valve according to the operating parameter comprises:

adjusting the opening degree of the electronic expansion valve of the outdoor unit according to a difference between the suction pressure of the outdoor unit and the preset pressure value, and a difference between the superheat degree of the exhaust gas and the preset exhaust gas value.

6. The method according to claim 4, wherein the adjusting the opening degree of the electronic expansion valve according to the operating parameter comprises:

adjusting the opening degree of the electronic expansion valve of the indoor unit according to a difference between the suction pressure of the outdoor unit and the preset pressure value, and a difference between the superheat degree of the exhaust gas and the preset exhaust gas value.

7. The method according to claim 5, wherein the larger the difference between the suction pressure of the outdoor unit and the preset pressure value, and the difference between the superheat degree of the exhaust gas and the preset exhaust gas value are, the greater an adjustment amplitude of the opening degree of the electronic expansion valve of the outdoor unit is.

8. The method according to claim 6, wherein the larger the difference between the suction pressure of the outdoor unit and the preset pressure value, and the difference between the superheat degree of the exhaust gas and the preset exhaust gas value are, the greater an adjustment amplitude of the opening degree of the electronic expansion valve of the indoor unit is.

9. A device for controlling pressure of units with height drop, comprising:

a memory; and at least one processor coupled to the memory and configured to:

monitor an operating mode of the units;

obtain an operating parameter corresponding to the operating mode according to the operating mode, comprising:

obtain, by a device configured to monitor operating parameters while in a cooling mode, an evaporation temperature of refrigerant of an indoor unit of the units, an opening degree of an electronic expansion valve (EEV) of the indoor unit, a suction pressure of an outdoor unit of the units, and a temperature of exhaust gas, in a case where the operating mode is the cooling mode, and adjust an opening degree of an EEV according to the operating parameter, further comprising:

adjusting an opening degree of an EEV of the outdoor unit to increase, to raise an intermediate pressure located from a posterior of the EEV of the outdoor unit to an anterior of the EEV of the indoor unit, in a case where the operating parameter satisfies a first preset condition, wherein the first preset condition is:

the opening degree of the EEV of the indoor unit is smaller than a preset opening degree value, or a superheat degree of the indoor unit determined according to the evaporation temperature of refrigerant of the indoor unit is smaller than a preset superheat value, the suction pressure of the outdoor unit is smaller than a preset pressure value, and a superheat degree of the exhaust gas determined according to the temperature of the exhaust gas is greater than a preset exhaust gas value; and adjusting the opening degree of the EEV of the outdoor unit to decrease, to reduce the intermediate pressure, in a case where the operating parameter satisfies a second preset condition, wherein the second preset condition is:

the opening degree of the EEV of the indoor unit is greater than the preset opening degree value or the superheat degree of the indoor unit determined according to the evaporation temperature of refrigerant of the indoor unit is greater than the preset superheat value, the suction pressure of the outdoor unit is greater than the pressure preset value, and the superheat degree of the exhaust gas determined according to the temperature of the exhaust gas is smaller than the preset exhaust gas value;

wherein the outdoor unit and the indoor unit have the height drop therebetween, wherein, in the case where the operating parameter satisfies the first preset condition, it is determined that the intermediate pressure is too low, and wherein, in the case where the operating parameter satisfies the second preset condition, it is determined that the intermediate pressure is too high.

10. The device according to claim 9, wherein the operating mode comprises a heating mode.

11. The device according to claim 10, wherein in a case where the operating mode is the heating mode, the obtaining the operating parameter corresponding to the operating mode according to the operating mode comprises:

obtaining, in the heating mode, a condensation temperature of refrigerant of the indoor unit, the suction pressure of the outdoor unit, and the temperature of the exhaust gas.

12. The device according to claim 11, wherein in a case where the operating mode is the heating mode, the adjusting the opening degree of the electronic expansion valve according to the operating parameter comprises:

adjusting an opening degree of an electronic expansion valve of the indoor unit, in a case where the operating parameter satisfies a third preset condition, wherein the third preset condition is:

a subcooling degree of the indoor unit determined according to the condensation temperature of refrigerant of the indoor unit is smaller than a preset subcooling value, the suction pressure of the outdoor unit is smaller than a preset pressure value, and a superheat degree of the exhaust gas determined according to the temperature of the exhaust gas is greater than a preset exhaust gas value;

and adjusting the opening degree of the electronic expansion valve of the indoor unit to increase, in a case where the operating parameter satisfies a fourth preset condition, wherein the fourth preset condition is:

the subcooling degree of the indoor unit determined according to the condensation temperature of refrigerant of the indoor unit is greater than the preset subcooling value, the suction pressure of the outdoor unit is greater than the preset pressure value, and the superheat degree of the exhaust gas determined according to the temperature of the exhaust gas is smaller than the preset exhaust gas value.

13. The device according to claim 9, wherein the adjusting the opening degree of the electronic expansion valve according to the operating parameter comprises:

adjusting the opening degree of the electronic expansion valve of the outdoor unit according to a difference between the suction pressure of the outdoor unit and the preset pressure value, and a difference between the superheat degree of the exhaust gas and the preset exhaust gas value.

14. The device according to claim 12, wherein the adjusting the opening degree of the electronic expansion valve according to the operating parameter comprises:

adjusting the opening degree of the electronic expansion valve of the indoor unit according to a difference between the suction pressure of the outdoor unit and the preset pressure value, and a difference between the superheat degree of the exhaust gas and the preset exhaust gas value.

15. An air conditioner device, comprising the device for controlling pressure of units with height drop according to claim 9.

16. The device according to claim 13, wherein the larger the difference between the suction pressure of the outdoor unit and the preset pressure value, and the difference between the superheat degree of the exhaust gas and the preset exhaust gas value are, the greater an adjustment amplitude of the opening degree of the electronic expansion valve of the outdoor unit is.

17. The device according to claim 14, wherein the larger the difference between the suction pressure of the outdoor unit and the preset pressure value, and the difference between the superheat degree of the exhaust gas and the preset exhaust gas value are, the greater an adjustment amplitude of the opening degree of the electronic expansion valve of the indoor unit is.

18. A non-transitory computer-readable storage medium on which computer program instructions are stored, the instructions, when executed by a processor, cause at least one computer device to:

monitor an operating mode of the units;

obtain an operating parameter corresponding to the operating mode according to the operating mode, comprising:

obtain, by a device configured to monitor operating parameters while in a cooling mode, an evaporation temperature of refrigerant of an indoor unit of the units, an opening degree of an electronic expansion valve (EEV) of the indoor unit, a suction pressure of an outdoor unit of the units, and a temperature of exhaust gas, in a case where the operating mode is the cooling mode; and adjust an opening degree of an EEV according to the operating parameter, comprising:

adjusting an opening degree of an EEV of the outdoor unit to increase, to raise an intermediate pressure located from a posterior of the EEV of the outdoor unit to an anterior of the EEV of the indoor unit, in a case where the operating parameter satisfies a first preset condition, wherein the first preset condition is:

the opening degree of the EEV of the indoor unit is smaller than a preset opening degree value, or a superheat degree of the indoor unit determined according to the evaporation temperature of refrigerant of the indoor unit is smaller than a preset superheat value, the suction pressure of the outdoor unit is smaller than a preset pressure value, and a superheat degree of the exhaust gas determined according to the temperature of the exhaust gas is greater than a preset exhaust gas value; and adjusting the opening degree of EEV of the outdoor unit to decrease, to reduce the intermediate pressure, in a case where the operating parameter satisfies a second preset condition, wherein the second preset condition is:

the opening degree of the EEV of the indoor unit is greater than the preset opening degree value or the superheat degree of the indoor unit determined according to the evaporation temperature of refrigerant of the indoor unit is greater than the preset superheat value, the suction pressure of the outdoor unit is greater than the pressure preset value, and the superheat degree of the exhaust gas determined according to the temperature of the exhaust gas is smaller than the preset exhaust gas value;

wherein the outdoor unit and the indoor unit have the height drop therebetween, wherein, in the case where the operating parameter satisfies the first preset condition, it is determined that the intermediate pressure is too low, and wherein, in the case where the operating parameter satisfies the second preset condition, it is determined that the intermediate pressure is too high.

19. The non-transitory computer-readable storage medium according to claim 18, wherein in a case where the operating mode is a heating mode, the obtaining the operating parameter corresponding to the operating mode according to the operating mode comprises:

obtaining, in the heating mode, a condensation temperature of refrigerant of the indoor unit, the suction pressure of the outdoor unit, and the temperature of the exhaust gas.

20. The non-transitory computer-readable storage medium according to claim 18, wherein the adjusting the opening degree of the electronic expansion valve according to the operating parameter comprises:

adjusting the opening degree of the electronic expansion valve of the outdoor unit according to a difference between the suction pressure of the outdoor unit and the preset pressure value, and a difference between the superheat degree of the exhaust gas and the preset exhaust gas value, wherein the larger the difference between the suction pressure of the outdoor unit and the preset pressure value, and the difference between the superheat degree of the exhaust gas and the preset exhaust gas value are, the greater an adjustment amplitude of the opening degree of the electronic expansion valve of the outdoor unit is.

* * * * *